US005775801A

United States Patent [19]

Shaffer

[11] Patent Number: 5,775,801

[45] Date of Patent: Jul. 7, 1998

[54] NEON TRAFFIC SIGNAL

[75] Inventor: Kevin Robert Shaffer, Oceanside, Calif.

[73] Assignee: McCain Traffic Supply, Inc., Vista, Calif.

[21] Appl. No.: 592,656

[22] Filed: Jan. 26, 1996

[51] Int. Cl.[6] ..... F21S 5/00; F21Q 3/00; H01J 61/30; H01J 61/70

[52] U.S. Cl. ..... 362/310; 362/227; 362/263; 362/267; 362/296; 362/812

[58] Field of Search ..... 362/216, 263, 362/267, 293, 310, 296, 252, 309, 800, 812, 227, 255, 306, 307, 362, 225, 23; 340/907; 343/484

[56] References Cited

U.S. PATENT DOCUMENTS

| | | | |
|---|---|---|---|
| 1,870,147 | 8/1932 | Smally | 362/255 |
| 1,981,903 | 11/1934 | Cadieux | 362/227 |
| 1,995,816 | 3/1935 | Adler, Jr. | 340/907 |
| 2,010,834 | 8/1935 | Wottring | 362/307 |
| 2,042,316 | 5/1936 | Johnson | 362/225 |
| 2,043,793 | 6/1936 | Cadieux | 362/225 |
| 2,102,191 | 12/1937 | Barclay | 362/225 |
| 2,294,883 | 9/1942 | Anderson et al. | 362/306 |
| 2,326,875 | 8/1943 | Miles | 362/225 |
| 2,553,906 | 5/1951 | Ferguson | 362/252 |
| 2,717,376 | 9/1955 | Carpenter et al. | 340/907 |
| 2,743,388 | 4/1956 | Bartley | 362/263 |
| 3,688,259 | 8/1972 | Rebillt | 340/907 |
| 3,870,991 | 3/1975 | Hayes | 340/907 |
| 4,384,271 | 5/1983 | Visser | 362/296 |
| 4,785,385 | 11/1988 | Holst | 362/309 |
| 4,914,435 | 4/1990 | Gould et al. | 362/812 |
| 5,089,943 | 2/1992 | Wolfelschneider | 362/23 |
| 5,270,910 | 12/1993 | Kile | 362/216 |
| 5,365,418 | 11/1994 | Gardner | 362/310 |
| 5,387,837 | 2/1995 | Roelevink et al. | 343/484 |
| 5,457,450 | 10/1995 | Deese et al. | 362/800 |

FOREIGN PATENT DOCUMENTS

| | | | |
|---|---|---|---|
| 2615929 | 12/1988 | France | 362/362 |

OTHER PUBLICATIONS

Welsbach Traffic Signal Company, Spiralite–the Fluorescent–Neon Signal Light, Feb. 17, 1941.

*Primary Examiner*—Ira S. Lazarus
*Assistant Examiner*—Matthew Spark
*Attorney, Agent, or Firm*—Baker, Maxham, Jester & Meador

[57] ABSTRACT

A high reliability, low power lamp for use in illuminating traffic signal indicators, comprising a "serpentine grid structure" comprising a first and a second overlapping neon light source. The two neon light sources are placed in close proximity to one another, thus allowing each light source to be illuminated more rapidly due to the reduced length of each tube and the interaction of each tube with the other. The physical layout of the indicator is preferably designed to enhance the operation of the neon tube by causing heat generated by the power supply to raise the temperature of the air surrounding the neon tube.

20 Claims, 4 Drawing Sheets

NEON TRAFFIC SIGNAL

BACKGROUND OF THE INVENTION

1. Field of the Invention

This invention relates to traffic signals, and more particularly, to an improved method and apparatus for displaying traffic signals using a neon light source.

2. Description of Related Art

Automatic traffic signals are ubiquitous in modern society. Almost every traffic intersection in every heavily populated region of the world is controlled by an automatic traffic signal. In many instances in which two streets intersect, traffic signals include the familiar three-color traffic signal indicators (red, yellow, and green) which provide a right of way to vehicles and pedestrians approaching the intersection by illuminating a green signal associated with one or more approach paths. A red signal associated with each other approach path indicates that vehicles approaching from such other paths must wait until the right of way is provided, as indicated by the red indication extinguishing and illumination of a green signal associated with a path. Such signals are commonly referred to as "ball indications". In addition to ball indications, "arrow indicators" are now being used at a great number of intersections. Arrow indicators provide a right-of-way to a vehicle making a turn (typically a left turn across oncoming traffic).

Currently, almost all of the indicators in use in the world are illuminated by incandescent lamps. Incandescent lamps typically have a life of approximately 8,000 hours. Accordingly, incandescent lamps must be changed approximately once per year. However, even a well managed annual replacement plan cannot prevent premature burnouts which may occur causing difficulty at affected traffic intersections. In most cases, premature burnouts require dispatch of an emergency crew to replace the lamp. While the task of changing the bulb is relatively simple, the fact that a work crew of at least two men must be on call 24 hours a day, and that the crew must divert traffic while replacing the bulb adds to the expense and inconvenience of premature burnouts. Furthermore, each time a premature burnout occurs, the risk of injury to the work crew which is dispatched raises the exposure of the organization responsible for the maintenance of the signal to liability for an injury to the members of the work crew. In addition, the failure of the signal increases the risk that vehicles will collide at the intersection, further increasing the exposure of the organization to liability for injury to both person and property.

One alternative to the incandescent lamp which would increase the life of the light source, and thus reduce the maintenance requirements, is a neon light source. Neon light sources have a far greater life, and thus have lower maintenance costs. However, neon light sources must be heated to a relatively high temperature before significant light is emitted. Achieving the required temperature causes a delay to occur between the time power is applied to a neon light source and the time the source is illuminated. This delay depends upon the ambient temperature in which the source is operating, and the size of the source. Since traffic signal indicators are constantly being cycled from off to on and are required to illuminate rapidly and predictably when power is applied, the use of neon has been considered undesirable. Furthermore, while incandescent lamps can be powered from a conventional 110 volt power source, neon lamps require conversion of the power source available for traffic signals. This conversion requires a transformer, making the power source required by a neon light source large and heavy. Thus, neon is generally deemed to be impractical as a light source for traffic signal indicators.

Still further, retrofitting neon lamps into the existing structures currently in use is an expensive venture, since the physical configuration of incandescent bulbs and neon lamps are very different.

Therefore, while there has been a concerted effort to find a low maintenance alternative to incandescent lamps for use in traffic signal indicators, the use of neon is currently considered to be impractical. Accordingly, it would be desirable to provide a low maintenance alternative to the incandescent lamp for use in traffic signal indicators which provides fast, reliable, energy efficient illumination of traffic signal indicators. The present invention provides such an alternative.

SUMMARY OF THE INVENTION

The present invention is a low maintenance alternative to the incandescent lamp for use in illuminating traffic signal indicators. The present invention reduces power consumption and maintenance, and increases reliability over prior art incandescent lamps currently used as traffic signal indicators. In accordance with the present invention, the traffic signal indicators preferably take the form of either a ball unit or an arrow unit.

A "serpentine grid structure" preferably comprising a first and a second overlapping neon light source is provided in the ball unit of the present invention. Each neon light source is a hollow glass tube filled with neon gas to a pressure of approximately 8 mm (0.3152 in.)/Hg. The two sources are placed in close proximity to one another, thus allowing each source to be illuminated more rapidly due to the reduced length of each tube and the interaction of each tube with the other. The serpentine grid structure is preferably mounted on a clear plastic disc and aligned with a mirrored reflector. The physical configuration of the serpentine grid structure results in very flat, even illumination. In green or yellow indicators, a small amount of mercury is introduced into the glass tube to alter the color of the light emitted. In the preferred embodiment of the present invention, the amount of mercury is approximately 25% less than is commonly used in prior art green or white light sources. The reduction in the amount of mercury increases the speed at which the light sources illuminate.

The tube of the neon light source used in the arrow unit of the present invention is formed into the shape of an arrow. As is the case with the ball unit of the present invention, the tube is filled with neon gas to a pressure of approximately 8 mm (0.3152 in.)/Hg. In the case of both the ball units as well as the arrow units, a lens with a prismatic pattern is used to diffuse the light that passes therethrough. In the case of the ball units, diffusing the light makes the grid less apparent. In addition, the prismatic lens is preferably colored to filter light emitted by the neon light source, thus providing a desirable color to the light which passes therethrough.

The physical layout of the ball and the arrow indicators is preferably designed to enhance the operation of the neon tube by causing heat generated by the power supply to raise the temperature of the air surrounding the neon tube. Heating of the ambient air assists in heating the neon light source to the temperature required for light to be emitted upon application of an electric charge through the tube, thus decreasing the time between application of power to, and illumination of, the light source.

BRIEF DESCRIPTION OF THE DRAWING

The objects, advantages, and features of this invention will become readily apparent in view of the following description, when read in conjunction with the accompanying drawing, in which.

DETAILED DESCRIPTION OF THE PREFERRED EMBODIMENTS

Throughout this description, the preferred embodiment and examples shown should be considered as exemplars, rather than limitations on the present invention.

Figure 1:
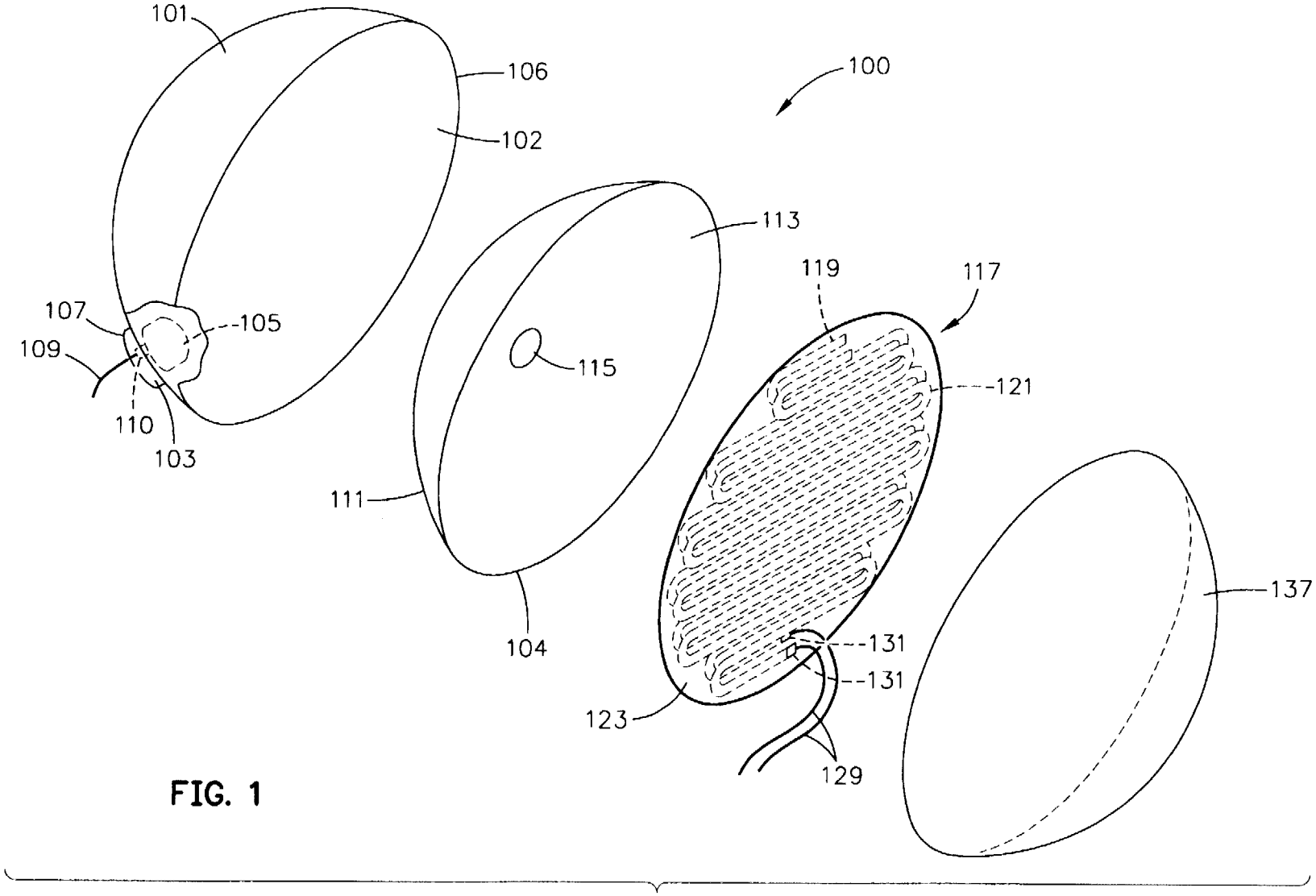
FIG. 1 illustrates the disassembled component parts of the present invention used to form a ball indicator.
Figure 2:
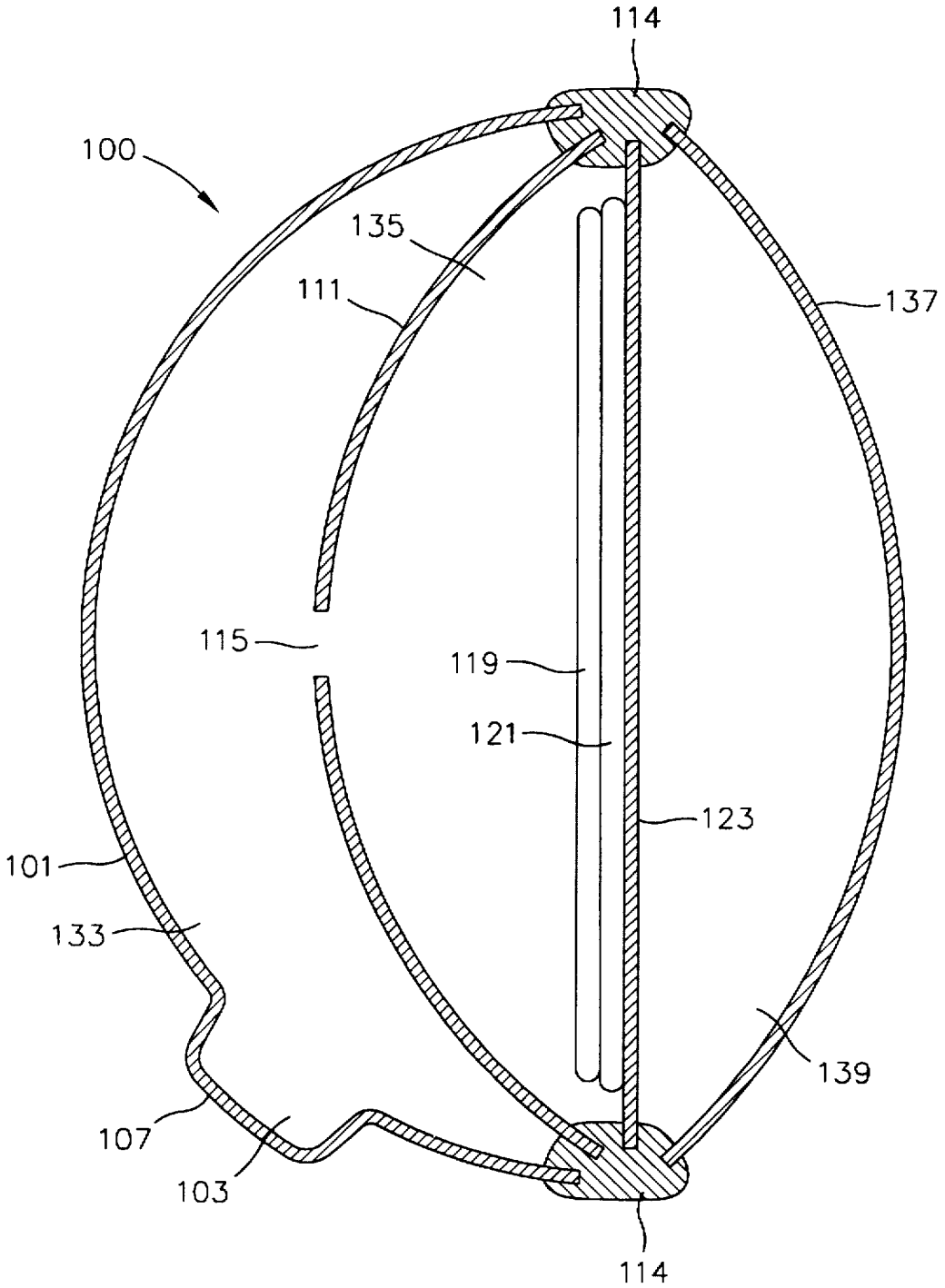
FIG. 2 is a cross sectional view of the assembled ball indicator.

The present invention is a neon traffic signal indicator having fast turn-on times, low maintenance requirements, low power consumption, and high reliability. FIG. 1 illustrates the disassembled component parts of the present invention used to form a ball indicator 100. FIG. 2 is a cross sectional view of the assembled ball indicator. A housing 101 is preferably a molded plastic hollow cup-shaped structure having an opening 102 at one end. The housing may be insulated to retain heat. The housing is preferably molded with an internal recess 103 which conforms to the profile of a small, lightweight power supply 105, such as part number OM11035G (for use with green indicators), O11035R (for use with red indicators), OM11035Y (for use with yellow indicators), each manufactured and distributed by Ohmega M.S., Inc. of San Marcos, Calif. In one embodiment of the present invention, the housing is relatively thin. Therefore, the internal recess 103 causes an external protuberance 107, as shown in FIG. 1. Wires which provide external power to the indicator 100 are preferably routed through a small opening in the housing 101 to the power supply 105. In accordance with one embodiment of the present invention, the wires 109 are coupled to the power supply by power supply terminals 110. This opening is preferably sealed with potting compound to maintain a hermetic seal.

An essentially hollow generally cup-shaped reflector backplate 111, preferably having a diameter across the opening 113 which is approximately 11⅞" (i.e., approximately equal to the diameter of the opening 102 of the housing 101) is inserted within the housing. The backplate 111 preferably is a silver-glass parabolic reflector with a focal length of approximately 3". A flexible gasket 114 (see FIG. 2) preferably seals the edge 104 of the reflector backplate to the edge 106 of the housing, thus creating a first air gap 133 between the reflector backplate and the housing 101. Heat generated by the power supply 105 warms the air that is trapped in this first air gap and aid in insulating the neon light source 119, 121 from the colder external air. It will be understood that any means for sealing the edge 104 of the reflector backplate 111 to the edge 106 of the housing 101 may be used. The reflector backplate preferably has a relatively small central opening 115 through which electrical connections to the neon light source are routed.

A "serpentine grid structure" 117 preferably comprising a first and a second overlapping neon light source 119, 121 mounted on a clear mounting disc 123 is provided as shown in FIG. 2. In an alternative embodiment of the present invention, the power supply may be mounted between the reflective backplate 111 and the neon light sources 119, 121. Each neon light source 119, 121 is a hollow glass tube filled with neon gas to a pressure of approximately 8 mm (0.3152 in.)/Hg. This pressure is substantially below conventional neon gas pressures and substantially reduces the amount of energy that is required to heat the gas to the point of excitation. By reducing the length of each neon tube, the amount of time between application of power and illumination of the indicator to the desired intensity is further reduced. By using more than one neon tube, the length of each tube can be reduced without reducing the total amount of light generated, thus further decreasing the time between application of power to the indicator and illumination of the indicator to the desired intensity. In green or yellow indicators, a small amount of mercury is preferably introduced into the glass tube of each neon light source 119, 121 to alter the color of the light emitted. In the preferred embodiment of the present invention, approximately 90 $mm^3$ (0.005492 $in.^3$) of mercury is introduced. This amount of mercury is approximately 25% less than is commonly used in prior art green or yellow light sources.

The neon gas is excited by applying an electrical charge therethrough. Conventional end electrodes 131 are provided to generate the charge. In one embodiment of the present invention, 60 milliampere end electrodes are provided. In the preferred embodiment, the end electrodes 131 are internally ceramic insulated to aid in heat retention and long term performance. Electrical conductors 129 (see FIG. 1) coupled to the end electrodes 131 are routed to the power supply 105 through the opening 115 in the reflector backplate 111. The opening 115 is preferably sealed after routing the conductors therethrough to seal the first air gap 133 between the housing 101 and the reflector backplate 111 and a second air gap 135 between the reflector backplate and the serpentine grid structure 117.

In embodiments in which the ball indicator 100 illuminates green, the glass tubes of the neon light sources 119, 121 have a 10 mm cross-sectional diameter, and are internally coated with a tinted phosphor, such as the model "EGL Seacrest 10 mml" tube manufactured by EGL, Inc. of Newark, N.J., and distributed by Interstate Electric Company (IEC) of Commerce, Calif. In embodiments in which the ball indicator 100 is red, each tube of the neon light source 119, 121 preferably is clear (i.e., no phosphor coating) with a 10 mm cross-sectional diameter, such as part number P/N08HC48 manufactured and distributed by VOLTARC Tubes, Inc. of Fairfield Conn. In embodiments in which the indicator is yellow, the glass tubes of the neon light source 119, 121 preferably have a cross-sectional diameter of 9 mm, and are internally coated with a white phosphor, such as part number "EGL V4500 9 mm", manufactured by EGL and distributed by IEC.

Figure 3A:
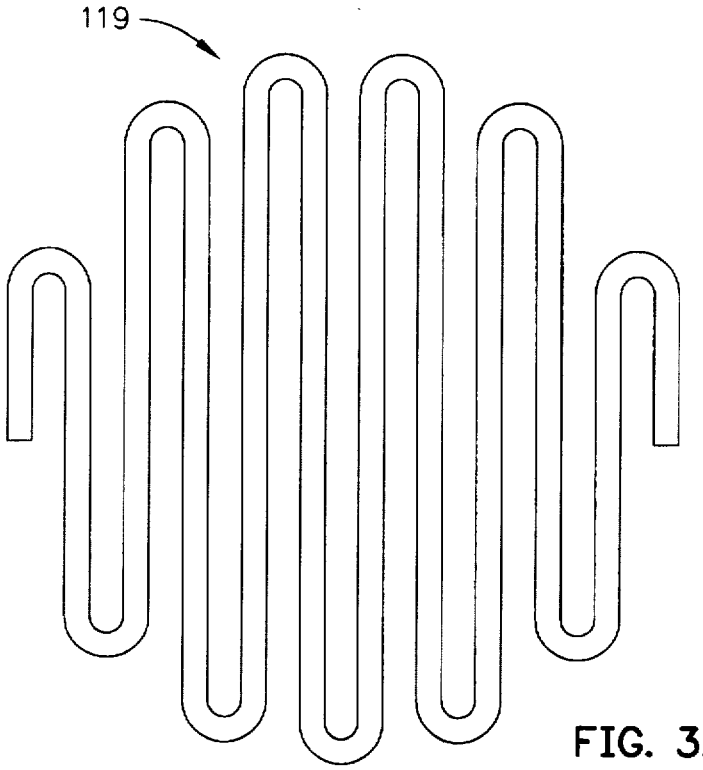
FIG. 3*a* is an illustration of the general shape of one neon light source.
Figure 3B:
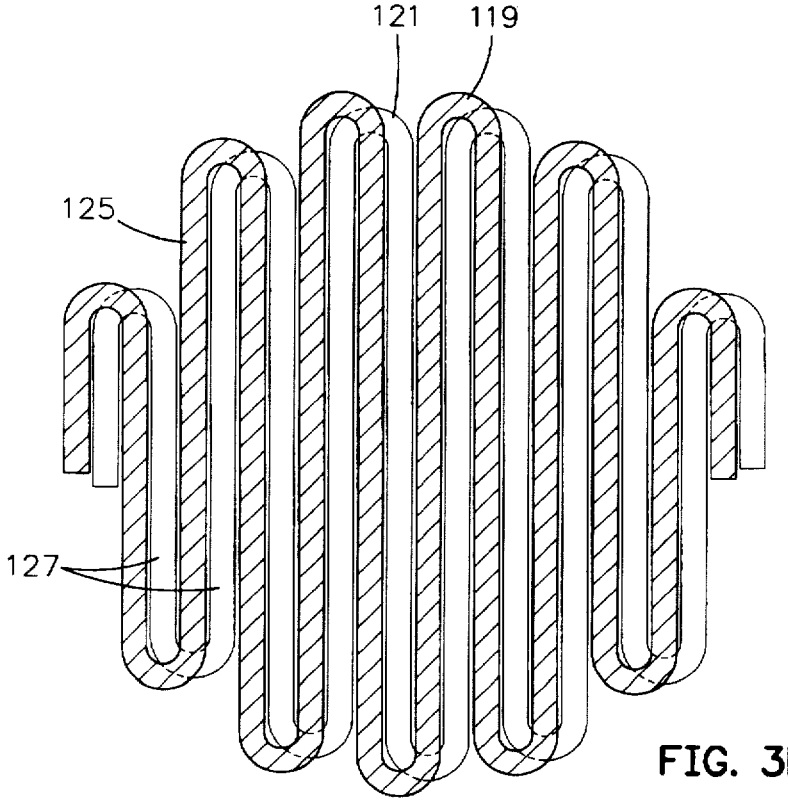
FIG. 3*b* is an illustration of the relative alignment of two neon light sources mounted on a clear disc.

The neon light sources 119, 121 are preferably placed in close proximity to one another. FIG. 3*a* is an illustration of the general shape of one neon light source 119. FIG. 3*b* is an illustration of the relative alignment of two neon light sources 119, 121. Each neon light source intended for use in the 12" ball indicator is preferably formed by bending a glass tube 180° at a radius of approximately 0.25" at intervals of 3½"; 5¼"; 7¼"; 8¼"; 9⅜"; and 9⅜", this pattern being mirrored, over a length of 8 feet per tube.

The first neon light source 119 is placed on top of the second neon light source 121 with essentially straight sections 125 of the first neon light source 119 disposed between two essentially straight sections 127 of the second neon light source 121 to interleave the first and second neon light sources. The second neon light source 121 is preferably glued to the clear disc 123. The first neon light source 119 is then preferably glued to the second neon light source 121. This alignment allows each neon light source 119, 121 to fill in the gap between straight sections of the other neon light source 121, 119, thus resulting in a relatively even illumination of the indicator. Furthermore, placing such neon light sources in close proximity to one another further decreases the amount of time required to bring the indicator to the desired intensity, since the excitation of each light source 119, 121 further excites the other.

The serpentine grid structure 117 is aligned with the reflector backplate 111, such that the neon light sources 119, 121 are on the side of the clear disc 123 that faces the housing 110. The edge of the clear disc is preferably sealed to the edge of the reflector backplate by the same gasket 114 that seals the reflector backplate to the housing. The physical configuration of the serpentine grid structure 117 results in very flat, even illumination. A lens 137 is then placed over the clear disc 123 of the serpentine grid structure. The lens may be a tinted prismatic lens which alters the color that is emitted by the indicator and defuses the light to obscure the serpentine pattern formed by the light sources 119, 121. For example, in the embodiment of the present invention in which the indicator is red, a red lens, such as part number 12-T00-LR-L manufactured and distributed by General Signals, Inc. of Evansville, Ind. is placed over the serpentine grid structure 117. Where the indicator is green, a green lens, such as part number 12-T00-G-L is placed over the serpentine grid. Likewise, where the indicator is yellow, a yellow lens, such as part number 12-T00-A-L is employed. The lens 137 is preferably sealed to the clear disc 123 of the serpentine grid structure 117 in order to provide a third air gap 139 between the disc 123 and the lens 137. Each of the three air gaps 133, 135, 137 insulates the light sources 119, 121 to allow each light source to maintain a relatively high temperature with respect to the outside air during times when the indicator is not illuminated. Thus, the amount of time between application of power to each light source 119, 121 and the illumination thereof will be less than would otherwise be the case if the light sources were less insulated.

It can be seen from the above description of the present invention that at least four factors cause the neon light source of the present invention to illuminate more rapidly than prior art neon light sources: (1) the neon gas within the glass tube is under less pressure than neon gas in conventional neon light sources; (2) air is sealed within the three air gaps within the housing, thus preventing heat from dissipating after turn-off; (3) lower levels of trace mercury are used in yellow and green indicators; and (4) two independent neon light sources are used in close proximity to interact with one another. Each embodiment of the present invention includes one or more of these factors in order to provide a fast illuminating neon traffic indicator.

Figure 4:
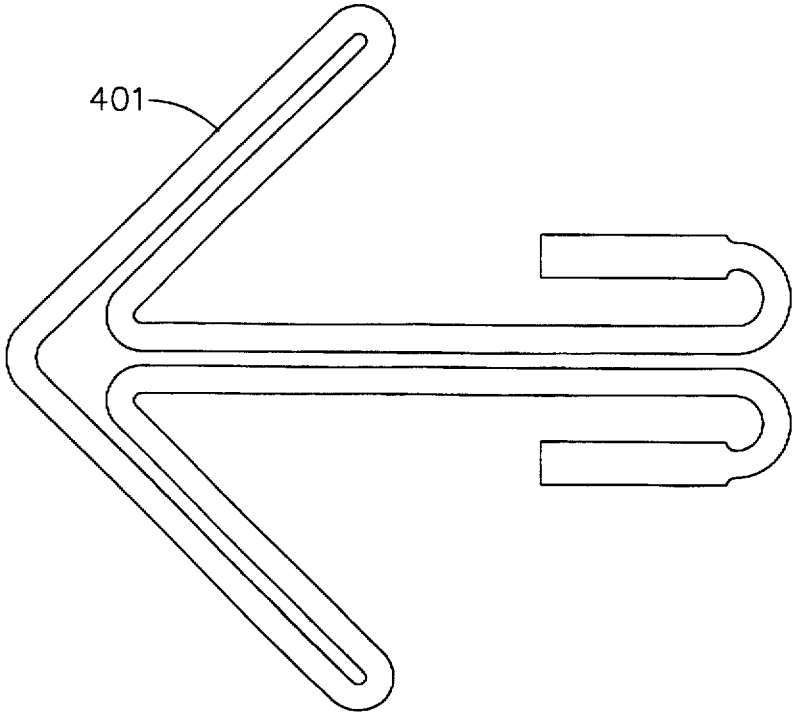
FIG. 4 is an illustration of a neon light source in accordance with the present invention in which the neon light source is shaped to form an arrow.

In addition to the ball indicators described above, this invention may be used to create arrow indicators. FIG. 4 is an illustration of a neon light source 401 in accordance with the invention in which the neon tube is shaped to form an arrow. An arrow indicator in accordance with the present invention is essentially the same as the ball indicator, except for the shape of the neon light source 401. In the case of an arrow indicator, the lens is preferably masked so that light passes only through a portion of the lens that is directly over the arrow shaped light source. Masking the lens helps to define the shape of the arrow.

The structure of the present invention is such that it essentially conforms to the physical shape and configuration of a conventional incandescent ball indicator. Thus, lamps of this invention can be used to replace such conventional incandescent indicators by removing the old lens, incandescent bulb, and reflective backplate from a conventional traffic signal. The new indicator unit is then installed in place of the conventional incandescent bulb. The power connections which were previously applied to the incandescent bulb are then connected to the power supply 105 of this invention.

SUMMARY

A number of embodiments of the invention have been described. Nevertheless, it will be understood that various modifications may be made without departing from the spirit and scope of the invention. For example, while the invention is described with two light sources being used in the ball indicators and one light source being used in the arrow indicators, each signal may use any number of neon light sources. That is, in an alternative embodiment of the invention, the ball indicator may use only one light source, and likewise, the arrow indicator may use two or more light sources. In addition, the ball and arrow indicators of the invention may be made in any size, and are limited only by the minimum radius to which tubes of the neon light sources can be formed. Accordingly, it is to be understood that the invention is not to be limited by the specific illustrated embodiment, but only by the scope of the appended claims.

I claim:

1. A scaled beam neon traffic signal indicator comprising:

(a) a generally cup-shaped housing having an essentially concave inner surface;

(b) a first neon light source mounted within the housing including about 90 $mm^3$ of mercury; and (c) a second neon light source mounted within the housing, the second light source being positioned with respect to the first light source and including about 90 $mm^3$ of mercury, such that the light emitted by each light source compliments the light emitted by the other light source and each light source excites the other resulting in faster illumination of each light source than would be the case if only one such light source were present.

2. The sealed beam neon traffic signal indicator of claim 1, wherein the first and second neon light source are tubes filled with neon at a pressure of about 8 mm/Hg.

3. The sealed beam neon traffic signal indicator of claim 1, wherein the first and second neon light source are each configured to form a serpentine structure, the first and second neon light source being mounted such that the straight sections of the first and second neon light source are interleaved.

4. The sealed beam neon traffic signal indicator of claim 1, and further comprising:

(a) a reflective back plate shaped to conform to, and fit within, the housing and forms a first air gap between the reflective back plate and the housing when installed within the housing;

(b) a power supply mounted in the first air gap between the housing and the backplate; and (c) a lens sealed around the edge of the inner surface of the housing to enclose the reflective back plate, the first and second light source, and the power supply and thus forming a second air gap between the lens and the first and second light source.

5. The sealed beam neon traffic signal indicator of claim 4, wherein the seal between the edge of the inner surface of the housing and the lens forms an air gap between the first neon light source and the lens.

6. The sealed beam neon traffic signal indicator of claim 4, wherein the housing includes power supply terminals coupled to the power supply, the power supply terminals being accessible at the exterior of the housing to allow power to be applied to the power supply from an external power source.

7. The sealed beam neon traffic signal indicator of claim 4, wherein the power supply includes power input leads, the housing being formed with lead access openings and the input leads being routed through the lead access openings to allow connection to an external power source.

8. The sealed beam neon traffic signal indicator of claim 7, wherein the lead access openings are sealed to prevent contaminants from entering the housing.

9. A sealed beam neon traffic signal indicator comprising:

(a) a generally cup-shaped housing having an essentially concave inner surface, the inner surface having a generally circular edge;

(b) a generally concave reflective back plate spaced apart from the housing such that a first air gap is formed between the housing and the reflective back plate;

(c) a first neon light source, mounted within the housing, comprising a tubular structure including about 90 $mm^3$ of mercury and;

(d) a second neon light source, mounted within the housing such that a second air gap is formed between the second light source and the reflective back plate, the second neon light source comprising a tubular structure formed in a grid and including about 90 $mm^3$ of mercury, the second light source being positioned with respect to the first neon light source such that the light emitted by each light source compliments the light emitted by the other light source and each light source excites the other resulting in faster illumination of each light source than would be the case if only one such light source were present.

10. The sealed beam neon traffic signal indicator of claim 9, and further comprising:

(a) a power supply mounted in the second air gap; and (b) a lens sealed around the edge of the inner surface of the housing to enclose the reflective back plate, the first and second light source, and the power supply.

11. A method for replacing a traffic signal indicator comprising the steps of:

(a) removing the lens, incandescent bulb, and reflective back plate from a traffic signal;

(b) installing in place of the removed reflective back plate, a sealed beam neon traffic signal indicator having:

(1) a generally cup-shaped housing having an essentially concave inner surface, the inner surface having a generally circular edge;

(2) a generally concave reflective back plate spaced apart from the housing such that a first air gap is formed between the housing and the reflective back plate;

(3) a first neon light source mounted within the housing and comprising a tubular structure including about 90 $mm^3$ of mercury;

(4) a second neon light source mounted within the housing such that a second air gap is formed between the second light source and the reflective back plate, the second light source comprising a tubular structure including about 90 $mm^3$ of mercury which is positioned with respect to the first light source such that the light emitted by each light source compliments the light emitted by the other light source and each light source excites the other resulting in faster illumination of each light source than would be the case if only one such light source were present;

(5) a power supply mounted in the second air gap; and (6) a lens sealed around the edge of the inner surface of the housing to enclose the reflective back plate, the first and second light sources, and the power supply; and (c) connecting the power supply mounted in the second air gap to a power source previously used to power the removed incandescent.

12. A sealed beam neon traffic signal indicator comprising:

(a) a generally cup-shaped housing having an essentially concave inner surface;

(b) a first neon light source mounted within the housing;

(c) a second neon light source mounted within the housing, the second light source being positioned in relatively close proximity to the first light source;

(d) a reflective back plate having an edge; and (e) a disc having an edge which essentially conforms to the shape of the edge of the housing and the reflective back plate, the edge of the disc being sealed to the edge of the reflective back plate to form an air gap between the reflective back plate and the disc, wherein the first and second neon light source are each mounted on the disc.

13. The sealed beam neon traffic signal indicator of claim 12, wherein the first and second neon light source are tubes filled with neon at a pressure of about 8 mm/Hg.

14. The sealed beam neon traffic signal indicator of claim 12, wherein the first and second neon light source are each configured to form a serpentine structure, the first and second neon light source being mounted such that the straight sections of the first and second neon light source are interleaved.

15. The sealed beam neon traffic signal indicator of claim 12, wherein the reflective back plate is shaped to conform to, and fit within, the housing and forms a first air gap between the reflective back plate and the housing when installed within the housing, and further including:

(a) a power supply mounted in the first air gap between the housing and the backplate; and (b) a lens sealed around the edge of the inner surface of the housing to enclose the reflective back plate, the first and second light source, and the power supply and thus forming a second air gap between the lens and the first and second light source.

16. The sealed beam neon traffic signal indicator of claim 15, wherein the housing includes power supply terminals coupled to the power supply, the power supply terminals being accessible at the exterior of the housing to allow power to be applied to the power supply from an external power source.

17. The sealed beam neon traffic signal indicator of claim 15, wherein the power supply includes power input leads, the housing being formed with lead access openings and the input leads being routed through the lead access openings to allow connection to an external power source.

18. The sealed beam neon traffic signal indicator of claim 17, wherein the lead access openings are sealed to prevent contaminants from entering the housing.

19. A sealed beam neon traffic signal indicator comprising:

(a) a generally cup-shaped housing having an essentially concave inner surface, the inner surface having a generally circular edge;

(b) a generally concave reflective back plate spaced apart from the housing such that a first air gap is formed between the housing and the reflective back plate, the reflective back plate having an edge; and (c) a disc having an edge which essentially conforms to the shape of the edge of the housing and the reflective back plate, the edge of the disc being sealed to the edge of the reflective back plate to form a second air gap between the reflective back plate and the disc;

(d) a first neon light source, mounted on the disc within the housing, comprising a tubular structure and;

(e) a second neon light source, mounted on the disc within the housing, the second neon light source comprising a tubular structure formed in a grid, the second light source being positioned with respect to the first neon light source such that the light emitted by each light source compliments the light emitted by the other light source and each light source excites the other resulting in faster illumination of each light source than would be the case if only one such light source were present.

20. A method for replacing a traffic signal indicator comprising the steps of:

(a) removing the lens, incandescent bulb, and reflective back plate from a traffic signal;

(b) installing in place of the removed reflective back plate, a sealed beam neon traffic signal indicator having;

(1) a generally cup-shaped housing having an essentially concave inner surface, the inner surface having a generally circular edge;

(2) a disc having an edge which essentially conforms to the shape of the edge of the housing and the edge of the reflective back plate, the edge of the disc being sealed to the edge of the reflective back plate to form an air gap between the reflective back plate and the disc;

(3) a first neon light source mounted on the disc within the housing and comprising a tubular structure;

(4) a second neon light source mounted on the disc within the housing, the second light source comprising a tubular structure which is positioned with respect to the first light source such that the light emitted by each light source compliments the light emitted by the other light source and each light source excites the other resulting in faster illumination of each light source than would be the case if only one such light source were present;

(5) a reflective back plate having an edge; and (6) a power supply mounted in the housing; and (7) a lens sealed around the edge of the inner surface of the housing to enclose the reflective back plate, the first and second light sources, and the power supply; and (c) connecting the power supply to a power source previously used to power the removed incandescent lamp.

* * * * *